US005105870A

United States Patent [19]

Merjane

[11] Patent Number: 5,105,870

[45] Date of Patent: Apr. 21, 1992

[54] BLIND SLATS

[76] Inventor: Habib Merjane, 11,595 Joseph Casavant, Montreal, Quebec, Canada, H3M 2B9

[21] Appl. No.: 570,844

[22] Filed: Aug. 22, 1990

[30] Foreign Application Priority Data

Apr. 10, 1990 [CA] Canada ..... 2014266

[51] Int. Cl.[5] ..... E06B 3/12

[52] U.S. Cl. ..... 160/236; 160/900

[58] Field of Search ..... 160/236, 900; 24/459, 24/662

[56] References Cited

U.S. PATENT DOCUMENTS

| | | | |
|---|---|---|---|
| 1,949,653 | 3/1934 | Moore | 160/236 |
| 2,074,482 | 3/1937 | Martens | 428/101 X |
| 2,169,873 | 8/1939 | Clark, Jr. | 160/236 |
| 4,195,680 | 4/1980 | Hyman et al. | 160/236 X |
| 4,519,435 | 5/1985 | Stier | 160/236 X |
| 4,612,680 | 9/1986 | Daiguji | 24/459 X |
| 4,628,980 | 12/1986 | Houillier | 160/236 X |
| 4,911,220 | 3/1990 | Hiller | 160/900 X |

FOREIGN PATENT DOCUMENTS

| | | | |
|---|---|---|---|
| 2402263 | 4/1979 | France | 40/606 |

*Primary Examiner*—Carl D. Friedman
*Assistant Examiner*—Korie H. Chan
*Attorney, Agent, or Firm*—Foley & Lardner

[57] ABSTRACT

A blind slat is disclosed, especially for use in blinds of the vertical type, comprising two thin transparent parts designed to be fixable one against the other by a system of the snapping type provided along their longitudinally opposed edges so as to thus form the forward and rearward faces of the slat. The system of the snapping type is designed to allow the insertion of a decorative strip of paper or web between the two thin parts prior to their being secured together. The thus obtained slat is of great interest in as much as the two parts, which are preferably made of extruded plastic, greatly facilitate the maintenance of the slat while preserving the natural esthetic of the web or the wallpaper. Besides, this structure makes it possible for the user to substitute, at will, any other decorative web or paper and, hence, make the structure extremely versatile.

11 Claims, 4 Drawing Sheets

BLIND SLATS

BACKGROUND OF THE INVENTION a) Field of the Invention

The present invention relates to a slat for blind, the latter being of any type but preferably vertical.

b) Brief Description of the Prior Art

The known technique for making blind slats consists in laminating a decorative web or paper on both sides of a small thin plastic plate of which the dimensions correspond to those of the slat, this thin plate acting as a support.

A first drawback of known technique is its lack of versatility for the consumer. Indeed, once he or she has selected a decorative web or paper of given color or design, it becomes impossible for him or her to change it as he or she wishes. In fact, the only way in which the web or design can be changed is in completely changing all of the blind slats.

A second drawback in this known technique is the upkeeping difficulty. Indeed, the web or wall-paper which form the outer layers of the laminate are in direct contact with the ambient air and hence are exposed to dust or grease spots or any other dirt which are practically impossible to clean without risking to destroy the structure of the laminate.

Various composite structures have been proposed for changing the decoration such as, for instance, that disclosed in U.S. Pat. No. 4,842,036. These composite structures are however relatively complex and not easy to use, namely by the consumer.

OBJECTS OF THE INVENTION

An object of the present invention is to provide a new type of composite slat for blind, especially of the vertical type, which is extremely simple and extremely versatile in as much as the manufacturer and/or the consumer may substitute, as he or she wishes, a particular strip of decorative paper or web or another without, for that reason, having to change the blind completely.

Another object of the invention is to provide a slat of the above mentioned type of which the upkeep is extremely simple in as much as the strip of decorative wall-paper or web is protected on both sides by two thin parts preferably made of plastic which can easily be cleaned whenever it is necessary.

Yet another object of the invention is to provide a slat of the above mentioned type, where in at least one the two faces of the decorative strip of web or paper is covered by a transparent plastic layer of which the translucency gives an extremely interesting visual effect while preserving the natural effect of the decorative web or paper.

SUMMARY OF THE INVENTION

According to the invention, these various objects are obtained by a two-faces slat for blind, of the type comprising:

a first thin part having elongated central surface provided with two longitudinal rectilinear and parallel edges, this central surface being shaped and sized to form one of the two faces of the slat;

a second thin part also having an elongated central surface provided with two longitudinal rectilinear and parallel edges, this central surface of the second part being shaped and sized similarly to the first part to form the other face of the slat, and means for holding the first and second parts against one another.

In accordance with the invention, the previously described slat is characterized in that the means for holding the two parts against one another are solid with longitudinal edges of the parts and are of the snapping type. This slat is likewise characterized in that these means of the snapping type are designed to leave a space between the parts which is sufficient to allow the insertion of a decorative strip of paper or web. Besides, this same slat is characterized in that at least of one of the central surfaces of the the two parts is transparent in order to allow viewing of the decorative strip which can be inserted.

Preferably, the first and the second parts forming the forward and rearward faces of the slat are made of extruded plastic. Preferably also, the central surfaces of the two parts are transparent and maybe concave when viewed in section whereby to give the slat a concave profile.

The plastic used for manufacturing the slat is preferably vinyl. However, any other transparent and extrudable plastic material can be used.

As may now be understood, the first and second thin parts, once superimposed and secured to one another, hold the decorative strip of paper or web tightly between them. Of course, at least one of these two parts must be transparent (crystal); the other may likewise be transparent or of a neutral colour provided only one of the two sides of the slat is to be exposed to the eyes.

The weight of the slat plays an important part. It follows that it is absolutely necessary for the first and second parts to be as thin as possible.

The width of the slat may be of any standard type, a width varying from 1 to 5 inches. As said previously, these slats may be flat or slightly concave according to needs.

BRIEF DESCRIPTION OF THE DRAWINGS

The invention will be better understood from the description that follows of several preferred embodiments made with reference to the appended drawings where in.

DESCRIPTION OF PREFERRED EMBODIMENTS

Figure 1:
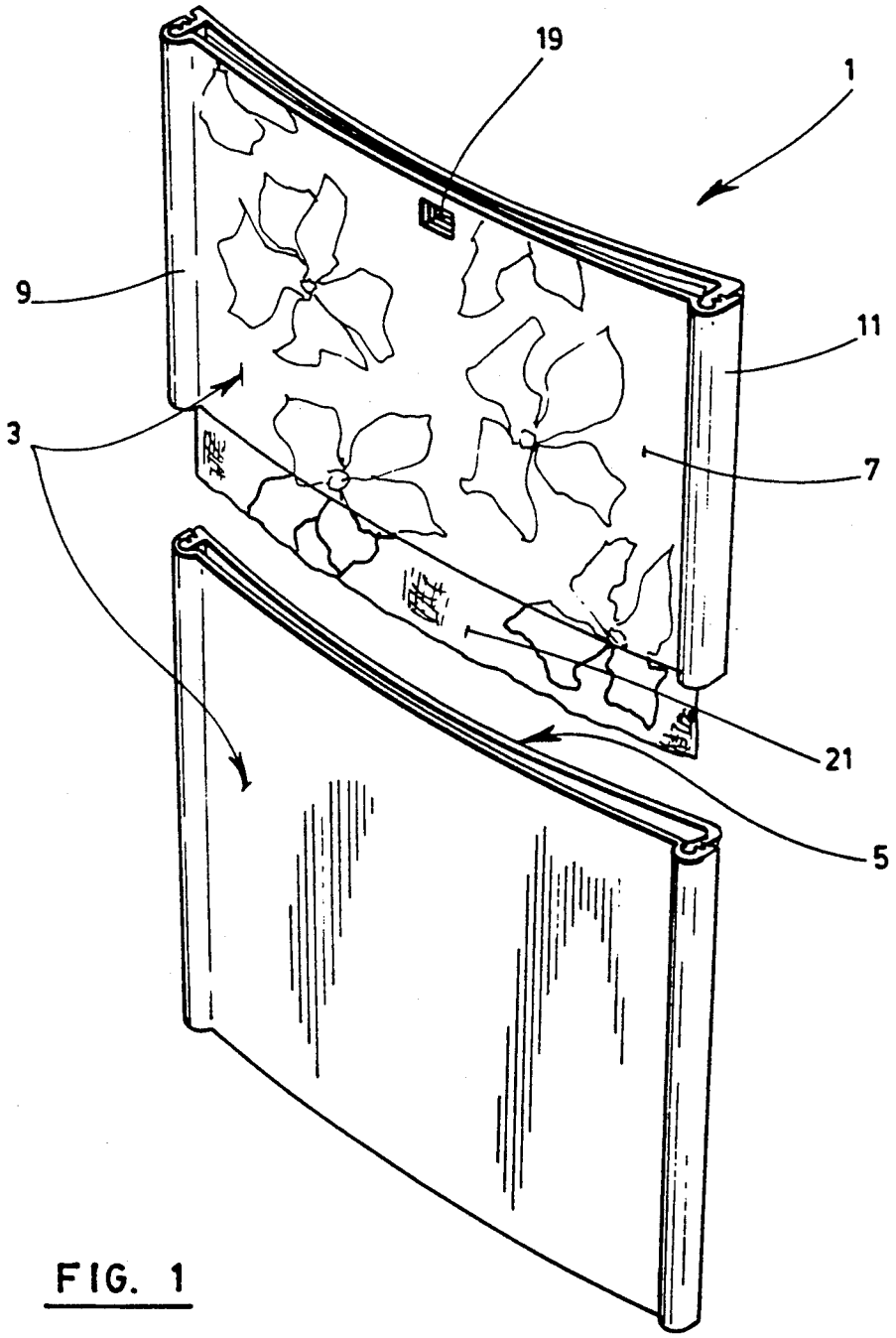
FIG. 1 is a cut perspective view of a blind slat according to the invention.
Figure 2:
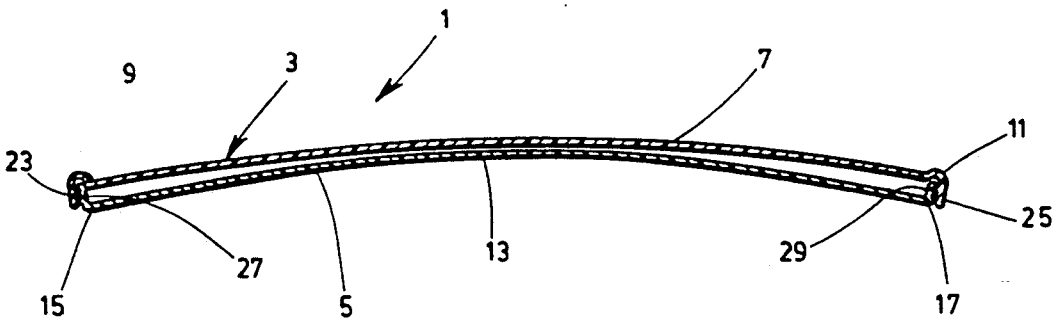
FIG. 2 is a transverse cross sectional view of the slat shown in FIG. 1.
Figure 3:
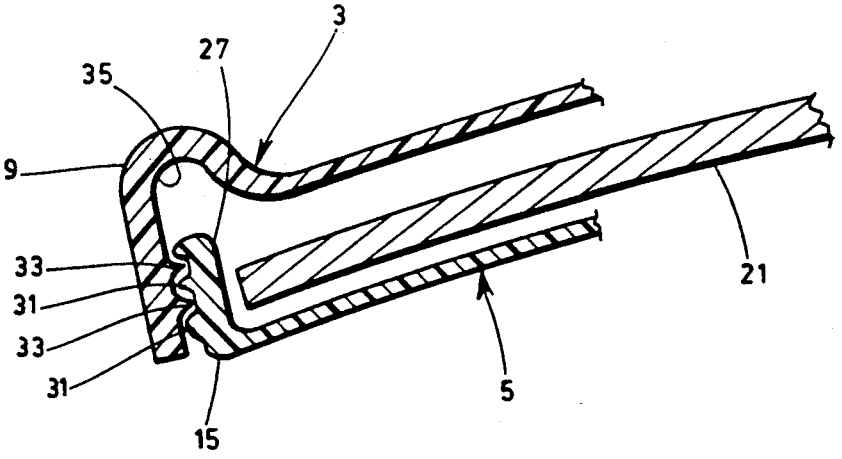
FIG. 3 is a cross sectional view, on an enlarged scale, of one of the two sides of the slat illustrated in FIGS. 1 and 2, illustrating its holding system of the snapping type.

The blind slat 1 illustrated in FIGS. 1 to 3 of the drawings is provided with 2 opposed faces each made up of a thin part 3,5 preferably made of extruded transparent vinyl material.

The first thin part 3 forming the front face of the slat has a central elongated surface 7 provided with 2 longitudinal rectilinear and parallel edges 9 and 11. The second part 5 forming the other face of the slat also has a central elongated surface 13 provided with two longitudinal rectilinear and parallel edges 15 and 17.

The central surfaces 7 and 13 of the parts 3 and 5 are essentially of the same dimension so that they may be applied one against the other to constitute together the slat as illustrated in FIG. 1. At the upper end of the two parts, once applied against one another, a central hole 19 may be provided for securing the assembly made up of the two thin parts secured one against the other on hooks foreseen for that purpose beneath the carriers of the blind, in the case of a vertical store.

Means solid with the longitudinal edges 9, 11, 15 and 17 of the parts 3 and 5 are provided to hold one against the other. Such holding means, which are of the snapping type as well be further be explained here and after, are designed to leave a space between the parts 3 and 5 which is sufficient to allow the insertion of a decorative strip 21 of paper or web.

According to the invention, at least one of the central surfaces 7, 13 of the two parts 3,5 must be transparent in order to allow viewing of the decorative strip 21 once it has been inserted. In the case shown in FIG. 3, the central surface which has to be transparent is surface 7 of the part 3.

In mcst cases, it is however preferable that the central surfaces 7 and 13 of the two parts be transparent in order that the assembly be completely reversible.

As clearly shown in FIG. 2, the central surfaces 7 and 13 of the parts 3 and 5 may advantageously be extruded such as to be slightly concave when viewed in section. In this particular case, the snapping type means mounted solid with the longitudinal edges of the parts 3 and 5 are conceived so that the two concave surfaces 7 and 13 come to fit one into the other so as thus to give the slat an equally concave section as clearly illustrated in FIG. 2.

Advantageously, the concavity of the slat 13 may be slightly greater than that of the slat 7 in order that space between the slats, at their center, be smaller than the same space near the longitudinal edges, this structure having the great advantage of slightly gripping the decorative strip 21 at the very center of the slat and over its full length.

Longitudinal edges 9 and 11 of the part 3 are integrally continued by two short lateral flanges 23 and 25 extending essentially perpendicular to the central surface 7, on the same side of the latter. Similarly, the longitudinal edges 15 and 17 of the other part 3 are integrally continued by 2 short lateral flanges 27 and 29 extending essentially perpendicular to the central surface 13 of this other part 5, on the same side of the latter.

As clearly illustrated in FIG. 3, the snapping type means used include teeth 29 that are turned inwardly, that is toward one another, on the two lateral edges 27 and 29 of the part 3 and teeth 31 that are turned outwardly, that is away from one another, on the two lateral edges 27 and 29 of the part 3. The snapping type means also include other teeth 33 that are turned inwardly, that is toward one another, on the two lateral flanges 23 and 29 of the part 3.

The two parts being essentially of the same width and the teeth 31 thereby facing the teeth 33 when the part 5 is fitted under the part 3, it will be readily understood that fixing and holding of the parts 3 and 5 are obtained by mere superimposition of the two parts one against the other with simultaneous nesting of the two outwardly toothed flanges, that is flanges 27 and 29 of part 5, between the two inwardly toothed flanges, that is flanges 23 and 25 of the part 3, for the teeth facing one another to interlock.

As illustrated in FIG. 3, the lateral flanges of at least one of the two parts (the two parts in the case of FIG. 3) comprise several teeth extending in parallel one above the other over the full lenght of the said flanges to allow nesting at a variable depth and thus accomodate the insertion of a decorative strip 21 selected from a variety of possible thicknesses.

As also illustrated in FIG. 3, the central surface 7 of the part 3 of which the lateral flanges 23 and 25 are inwardly toothed, is made in such way as to form to longitudinal grooves (35 in FIG. 3) close to its edges 9 and 11 to thereby provide space for flanges 27 and 29 of the other part 5 and thereby allow maximum interlocking of the teeth.

Of course, interlocking and holding are insured thanks to the inherent resiliency resilience of the parts 3 and 5 and to their lateral edges, this resilience being obtained in a natural way due to the thinness of the plastic parts thus extruded.

Figure 4:
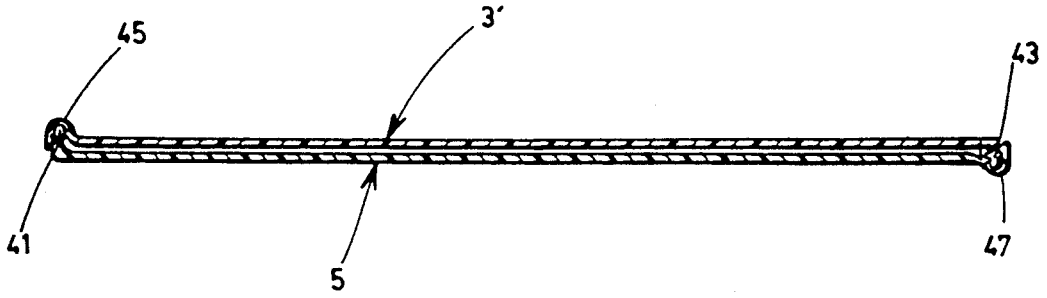
FIG. 4 is a transverse cross sectional view of a second embodiment of the invention.
Figure 5:
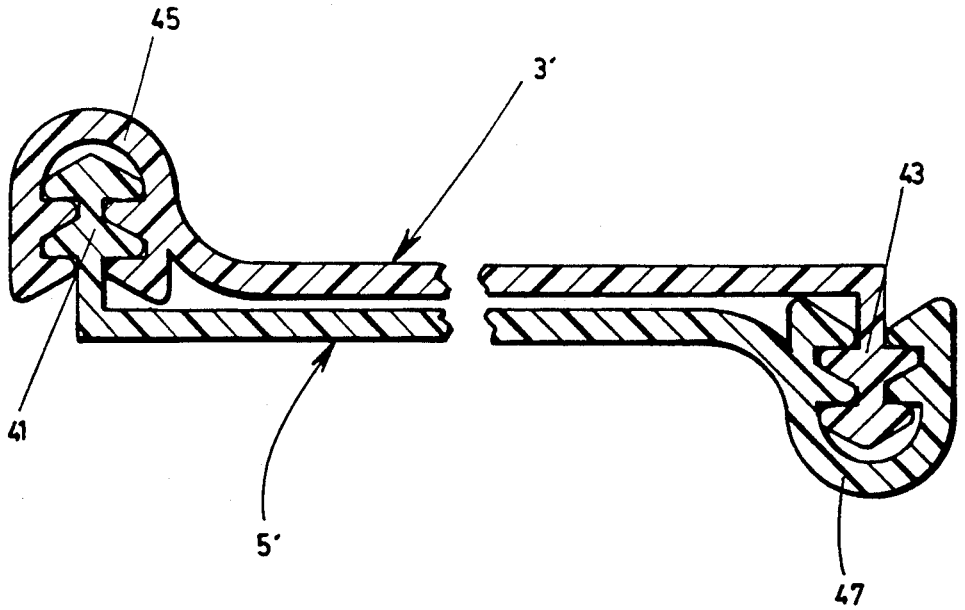
FIG. 5 is a transverse cross sectional view, on an enlarged scale, of the holding system of the snapping type for the slat of FIG. 4.
Figure 6:
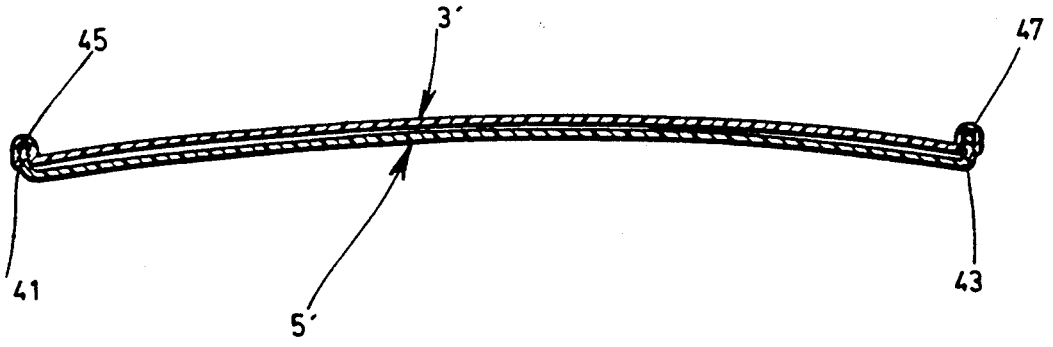
FIG. 6 is a transverse cross sectional view of a third embodiment of the invention.
Figure 7:
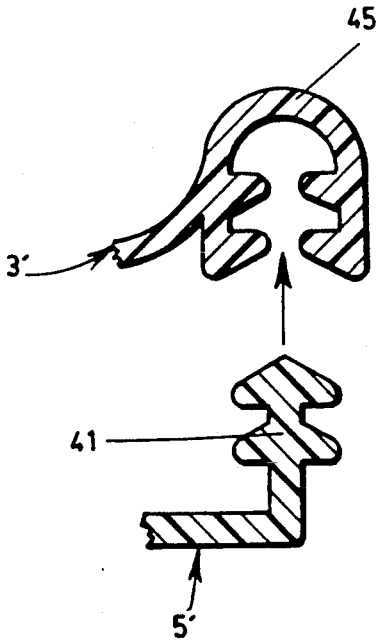
FIGS. 7 and 8 are cross sectional views, on a enlarged scale, of the holding system of the snapping type for the slat of FIG. 6, shown in open and closed conditions, respectively.
Figure 8:
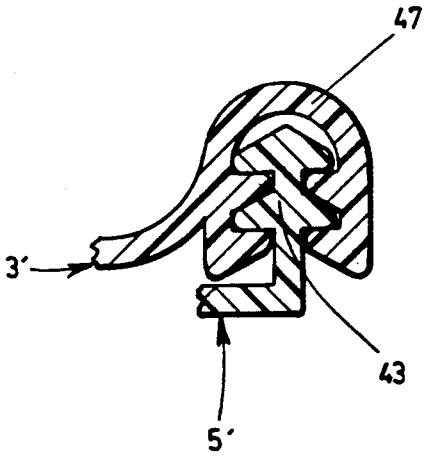

According to another preferred embodiment illustrated in FIGS. 4, 5 and 6, the snapping-type means serving to secure the parts 3' and 5' together include two laterally toothed beads 41 and 43 located along the two laterally opposed edges of the two parts and sized in such way as to be capable of being force fitted into two corresponding longitudinal grooves 45 and 47 provided with teeth along their opposed side walls, the grooves being located along the other two laterally opposed edges of the two parts.

In the case illustrated in FIG. 4, the parts 3' and 5' are completely symmetrical. In fact, these two parts are absolutely identical except in their mounting where they are arranged in reverse directions. In such a case, one of the edges of each is provided with a bead and the other is provided with a corresponding groove which means that when the two parts are disposed in reversed directions, they may be secured one to the other by cogging of the toothed bead of one part into the toothed groove of the other part and vice versa. This infers, of course, that the two parts 3' and 5' be completely flat.

In the other embodiment illustrated in FIG. 6, the part 3' has the two toothed grooves 45 and 47 where as the part 5' has the two longitudinal toothed beads 41 and 43. In the latter case, the two parts are of necessity differently extruded. However, it than becomes possible to give them a certain concavity, as shown.

Of course, other modifications are possible within the script earlier of the present invention for the embodiments described above which have been given marely by way of illustration.

What is claimed is:

1. In a two-face slat for blind, of the type comprising:

a first thin part having an elongated central surface provided with two longitudinal rectilinear parallel edges, said central surface being shaped and sized to form one of the two faces of the slat;

a second thin part also having an elongated central surface provided with two longitudinal rectilinear and parallel edges, said central surface of said second part being shaped and sized similarly to the central surface of the first part to form the other face of the slat, and means for holding said first and second parts against one another;

the improvement wherein:

said means for holding the two parts against one another are solid with the longitudinal edges of said parts and are of the snapping type;

said means of the snapping type are designed to leave a space between the parts which is sufficient to allow the insertion of a decorative strip of paper or web;

at least one of the two central surfaces of the two parts is transparent to allow viewing of the decorative strip capable of being inserted; and said means of the snapping type in that the snapping type include two longitudinal laterally toothed beads, extending along two laterally opposed edges of the two parts and sized so as to be capable of being force-fitted into two corresponding longitudinal grooves of which the opposed walls are likewise toothed, said grooves extending along the other two laterally opposed edges of said two parts.

2. A slat according to claim 1, wherein said first and second parts are made of extruded plastic.

3. A slat according to claim 2, wherein the central surfaces of said first and second parts are transparent.

4. A slat according to claim 1, wherein the central surfaces of said first and second parts are slightly concave and said means of the snapping type are mounted such that the two concave surfaces come to fit one into the other so that the slat has a likewise concave section.

5. In a two-face slat for blind, of the type comprising:

a first thin part having an elongated central surface provided with two longitudinal rectilinear parallel edges, said central surface being shaped and sized to form one of the two faces of the slat;

a second thin part also having an elongated central surface provided with two longitudinal rectilinear and parallel edges, said central surface of said second part being shaped and sized similarly to the central surface of the first part to form the other face of the slat, and means for holding said first and second parts against one another;

the improvement wherein:

said means for holding the two parts against one another are solid with the longitudinal edges of said parts and are of the snapping type;

said means of the snapping type are designed to leave a space between the parts which is sufficient to allow the insertion of a decorative strip of paper or web;

at least one of the two central surfaces of the two parts is transparent to allow viewing of the decorative strip capable of being inserted; and wherein, on the one hand, the longitudinal edges of each part are integrally extended by two small lateral flanges stretching essentially perpendicularly to the central surface of the part of the same side thereof and wherein, on the other hand, said means of the snapping type include teeth outwardly turned on the two lateral flanges of one of the parts and inwardly turned on the lateral flanges of the other part;

fixing together of the two parts being obtained by mere positioning of the said parts against one another with simultaneous fitting of the two outwardly toothed flanges between the two inwardly toothed flanges so that the teeth thereof, facing one another, interlock.

6. A slat according to claim 5, wherein the lateral flanges of at least one of the two parts comprises several teeth stretching in parallel relation one below the other over the full length of said flanges to allow nesting of variable depth and hence capable of accommodating, at will, various possible thicknesses of the inserted decorative strip.

7. A slat according to claim 6, wherein the central surface of the the part having said inwardly toothed lateral walls are so shaped as to define two longitudinal grooves near the longitudinal edges thereof to provide room for the outwardly toothed lateral flanges of the other part.

8. A slat according to claim 7 wherein said first and second parts are made of extruded plastic.

9. A slat according to claim 7, wherein said first and second parts are made of extruded plastic and wherein the central surfaced of said two parts are transparent.

10. A slat according to claim 5, wherein said first and second parts are made of extruded plastic, wherein the central surfaces of said first and second parts are slightly concave, and wherein said means of the snapping type are mounted such that the two concave surfaces come to fit one into the other whereby to give the slat a likewise concave section.

11. A slat according to claim 5, wherein the central surfaces of said first and second parts are slightly concave and said means of the snapping type are mounted such that the two concave surfaces come to fit one into the other so that the slat has a likewise concave section.

* * * * *